US007892408B2

(12) United States Patent
Rhodes et al.

(10) Patent No.: US 7,892,408 B2
(45) Date of Patent: Feb. 22, 2011

(54) CATHODIC ELECTROCATALYST LAYER FOR ELECTROCHEMICAL GENERATION OF HYDROGEN PEROXIDE

(75) Inventors: Christopher P. Rhodes, College Station, TX (US); Charles L. K. Tennakoon, Coppel, TX (US); Waheguru Pal Singh, College Station, TX (US); Kelvin C. Anderson, Flynn, TX (US)

(73) Assignee: Lynntech, Inc., College Station, TX (US)

( * ) Notice: Subject to any disclaimer, the term of this patent is extended or adjusted under 35 U.S.C. 154(b) by 670 days.

(21) Appl. No.: 11/935,657

(22) Filed: Nov. 6, 2007

(65) Prior Publication Data

US 2009/0114532 A1 May 7, 2009

(51) Int. Cl.

| | |
|---|---|
| ***C25B 11/06*** | (2006.01) |
| ***H01M 4/137*** | (2010.01) |
| ***H01M 4/02*** | (2010.01) |
| ***H01M 4/04*** | (2010.01) |
| ***H01M 4/1399*** | (2010.01) |

(52) U.S. Cl. ..... 204/283; 204/252; 204/253; 429/534; 429/535; 429/523; 429/530; 429/531; 429/532; 429/452; 429/471; 429/483; 429/480; 429/481; 429/482; 429/484; 429/492; 429/493; 429/494

(58) Field of Classification Search ..... 204/283, 204/252, 253; 429/40, 41, 42, 44, 45, 30, 429/32, 33, 523, 530, 531, 532, 534, 535
See application file for complete search history.

(56) References Cited

U.S. PATENT DOCUMENTS

| | | | | |
|---|---|---|---|---|
| 5,972,196 | A * | 10/1999 | Murphy et al. | 205/466 |
| 2004/0007476 | A1 * | 1/2004 | Tennakoon et al. | 205/343 |

FOREIGN PATENT DOCUMENTS

| | | | |
|---|---|---|---|
| EP | 1568801 | A1 | 8/2005 |
| WO | WO03010360 | | 2/2003 |
| WO | WO03010360 | A1 | 2/2003 |
| WO | WO2004005246 | A | 1/2004 |
| WO | WO2004005246 | A2 | 1/2004 |

OTHER PUBLICATIONS

PCT/US2008/08237 "International Search Report and Written Opinion of the International Searching Authority", Jun. 23, 2009, pp. 1-13.

PCT, "PCT/US2008/082437—International Preliminary Report on Patentability", International filing date Nov. 5, 2008, 7 pages.

* cited by examiner

*Primary Examiner*—Bruce F Bell
(74) *Attorney, Agent, or Firm*—Jeffrey L. Streets; Streets & Steele

(57) ABSTRACT

A cathodic gas diffusion electrode for the electrochemical production of aqueous hydrogen peroxide solutions. The cathodic gas diffusion electrode comprises an electrically conductive gas diffusion substrate and a cathodic electrocatalyst layer supported on the gas diffusion substrate. A novel cathodic electrocatalyst layer comprises a cathodic electrocatalyst, a substantially water-insoluble quaternary ammonium compound, a fluorocarbon polymer hydrophobic agent and binder, and a perfluoronated sulphonic acid polymer. An electrochemical cell using the novel cathodic electrocatalyst layer has been shown to produce an aqueous solution having between 8 and 14 weight percent hydrogen peroxide. Furthermore, such electrochemical cells have shown stable production of hydrogen peroxide solutions over 1000 hours of operation including numerous system shutdowns.

22 Claims, 4 Drawing Sheets

CATHODIC ELECTROCATALYST LAYER FOR ELECTROCHEMICAL GENERATION OF HYDROGEN PEROXIDE

STATEMENT REGARDING FEDERALLY SPONSORED RESEARCH

This invention was made with government support under contract number NNJ-04-JC-32C awarded by the National Aeronautics and Space Administration (NASA) and contract number W911NF-06-C-0102 awarded by the United States Department of Defense (Army). The government has certain rights in this invention.

BACKGROUND OF THE INVENTION

1. Field of the Invention

The present invention relates to the electrochemical production of an aqueous hydrogen peroxide solution and the composition of gas diffusion electrodes used for generating high yields of hydrogen peroxide.

2. Background of the Related Art

Hydrogen peroxide has strong oxidizing properties and does not leave a chemical residue. Accordingly, hydrogen peroxide has been found to be useful in many applications, such as the bleaching of paper, disinfection of wounds and medical devices, water treatment, decontamination of pathogenic agents, destruction of environmental wastes, and other applications. The various applications for hydrogen peroxide have their own unique requirements, but it is often beneficial to produce hydrogen peroxide on demand or at the point of use to avoid logisitical, cost, and safety issues associated with shipping and avoid the need to add stabilizing agents to the hydrogen peroxide solution which limit degradation of hydrogen peroxide.

For these and other reasons, electrochemical methods and apparatus for the synthesis of hydrogen peroxide have been developed. Many of these electrochemical methods are designed to convert water to oxygen and protons at the anode and convert oxygen and protons to hydrogen peroxide at the cathode when electrical current or potential is applied between the anode and cathode of a suitable electrochemical cell. Electrochemical generation of hydrogen peroxide has been performed in both acidic and alkaline solutions, as described in Tatapudi and Fenton, *J. Electrochem. Soc.* 140, L55-L57, 1993; Gupta and Oloman, *J. Appl. Electrochem.* 36, 255-264, 2006; Brillas, et. al. *Electrochem. Acta* 48, 331-340, 2002; and Gyenge and Oloman, *J. Appl. Electrochem.* 33, 665-663 (2003). Rather than using a "flow-through" electrochemical reactor which flows a liquid acidic or basic aqueous electrolyte to the cathode, there are specific advantages to generating hydrogen peroxide using a gas diffusion electrode which flows gas to the cathode. A gas diffusion electrode used in combination with a polymer electrolyte membrane allows the hydrogen peroxide to be generated and collected without additional acid or base present, which can be desirable for many applications since the acid and base can corrode or damage system components that use the produced hydrogen peroxide, such as a hydrogen peroxide vaporization system for decontamination and other uses. Another advantage of generating hydrogen peroxide using a gas diffusion electrode is that the rate of hydrogen peroxide production for a given cell area can be higher than when using a "flow-through" electrochemical reactor based on the significantly higher diffusion coefficient of oxygen in the gas phase ($\sim 10^{-5}$ $m^2/s$) compared to the aqueous phase ($\sim 10^{-10}$ $m^2/sec$). The mass transport limitations caused by water "flooding" within hydrogen-oxygen fuel cell cathodes has been well documented, as described in Baschuk and Li, *J. Power Sources* 86, 181-196, 2000. In addition, within a gas diffusion electrode, high concentrations of hydrogen peroxide can be generated continuously without requiring recirculation and then collection of an electrolyte solution in a "batch mode" configuration.

U.S. Pat. No. 5,972,196 (Murphy, et al.) describes that hydrogen peroxide can be generated electrochemically using a gas diffusion cathode and an anode separated by a cation-exchange polymer electrolyte membrane. This design allows hydrogen peroxide to be generated at the cathode within a gas diffusion electrode without the presence of a liquid electrolyte. For the operation of the electrochemical cell, protons are generated at the anode using either water (Eq. 1) or hydrogen (Eq. 2)

$$\text{Anode: } 2H_2O \rightarrow O_2 + 4H^+ 4e^- \quad E^\circ = -1.229\ V\ (25^\circ\ C.) \qquad \text{(Eq. 1)}$$

$$\text{Anode: } 2H_2 \rightarrow 4H^+ 4e^- \quad E^\circ = 0.000\ V (25^\circ\ C.) \qquad \text{(Eq. 2)}$$

Protons from the anode are transferred across the cation-exchange membrane to the cathode compartment towards the negatively charged electrode. The cathode compartment is fed with oxygen or air for the generation of hydrogen peroxide by the reduction of oxygen according to the following reaction.

$$\text{Cathode: } O_2 + 2H^+ 2e^- \rightarrow H_2O_2 \quad E^\circ = 0.682\ V\ (25^\circ\ C.) \qquad \text{(Eq. 3)}$$

The hydrogen peroxide reaction product must be promptly removed from the vicinity of the cathode to prevent further reduction. An alternative side reaction (Eq. 4), listed below, produces water rather than hydrogen peroxide.

$$\text{Cathode: } O_2 + 4H^+ 4e^- \rightarrow 2H_2O \quad E^\circ = 1.229\ V\ (25^\circ\ C.) \qquad \text{(Eq. 4)}$$

In addition, further reduction of hydrogen peroxide may also occur, as described by the following equation (Eq. 5).

$$\text{Cathode: } H_2O_2 + 2H^+ 2e^- \rightarrow 2H_2O \quad E^\circ = 1.776\ V\ (25^\circ\ C.) \qquad \text{(Eq. 5)}$$

The specific construction and composition of the cathodic electrode must be optimized to reduce decomposition of hydrogen peroxide through electroreduction via potential side reactions (Eq. 4 and Eq. 5). In addition, the cell design and components must be optimized to minimize hydrogen peroxide decomposition via non-Faradic processes such as surface-catalyzed decomposition at endplates and other cell components. The design of the components of an electrochemical cell is critically important to the hydrogen peroxide concentration, current efficiency, and long term operation of the cell. In particular, since hydrogen peroxide is synthesized at the cathode of an electrochemical cell, there has been significant research and development directed at cathode designs for increased production of hydrogen peroxide.

U.S. Pat. No. 5,972,196 (Murphy, et al.) discloses an electrochemical cell for the generation of ozone at the anode and the generation of either water or hydrogen peroxide at the cathode. The electrochemical cell has a gas diffusion cathode electrode comprising a semi-hydrophobic catalyst layer supported on a hydrophobic gas diffusion layer of carbon cloth or carbon fiber paper. The hydrophobic gas diffusion layer has a carbon cloth or carbon fiber paper impregnated with a sintered mass derived from fine carbon powder and a polytetrafluoroethylene emulsion. The semi-hydrophobic catalyst layer may comprise a proton exchange polymer, polytetrafluoroethylene and a high surface area carbon-supported, pyrolyzed cobalt porphyrin, such as cobalt tetrakis(4-methoxyphenyl) porphyrin (CoTTMP). This electrochemical cell was shown to produce hydrogen peroxide concentrations up to about 1.4 wt. %.

U.S. Pat. No. 6,555,055 (Cisar, et al.) discloses an electrochemical cell for the electrochemical production of hydrogen peroxide. The electrolyzer includes a cathode catalyst composed of cobalt (II) tetrakis-(4-methoxyphenyl)-porphine (CoTMPP) which was adsorbed onto high surface area carbon black and then pyrolyzed. The catalyst was suspended in a Nafion/water mixture before painting and hot pressing onto the membrane. An aqueous hydrogen peroxide solution was produced having a hydrogen peroxide concentration as high as 2.2 wt. %.

U.S. Pat. No. 6,712,949 (Gopal) discloses a cathode structure for use in electrochemical synthesis of hydrogen peroxide. A redox catalyst is mixed with carbon, PTFE, and a performance modifier or enhancer such as a quaternary ammonium compound. This mixture is then directly deposited on a high surface area carbon felt or porous carbon cloth. The resulting cathode may be used in combination with an ion exchange membrane and an anode for oxidization of water to produce oxygen and protons. In contrast to the previous two examples cited, the cathode is utilized in an electrochemical cell with anolyte and catholyte solutions circulating through anolyte and catholyte compartments separated by a proton exchange membrane. Hydrogen peroxide concentrations as high as about 7 wt. % are reported to have been achieved in an acidic solution (1 $NH_2SO_4$) that contained dissolved oxygen in solution. Within this configuration, the components used were not designed for use within a gas diffusion electrode where flowing gas (air or oxygen) is used within the cathode rather than a flowing aqueous solution. The presence of a flowing acidic solution within the cathode influences both the generation of hydrogen peroxide and its removal from the electrode. The acidic solution has a high concentration of mobile protons and can also contribute to preventing the hydrogen peroxide from decomposing as described above.

U.S. Pat. No. 6,712,949 (Gopal) also discloses the use of high molecular weight organic compounds and polymers including poly(2-vinylpyridine) poly(4-vinylpyridine), poly (4-vinylpyridinium tribromide), poly(4-vinylpyridine) methyl chloride quaternary salt, and poly(4-vinylpyridinium p-toluenesulfonate) as "performance modifiers" within cathodes used for the electrochemical production of hydrogen peroxide. The concentration of hydrogen peroxide produced was higher for electrodes containing the "performance modifiers" compared to electrodes without this component.

The use of surfactants or "additives" including trioctylmethylammonium chloride has been shown to influence the hydrogen peroxide concentration and current efficiency within "flow-through" electrochemical reactors (Gyenge and Oloman, *J. Electrochem. Soc.* 152, D42-D53, 2005). Similar to U.S. Pat. No. 6,712,949, the flow-through reactor process involved the use of flowing acidic or basic solution within the cathode.

There remains a need for a cathodic gas diffusion electrode and specific components within the electrode which allow high concentrations of hydrogen peroxide to be produced and allow removal of the hydrogen peroxide to prevent its decomposition. It would be desirable for the electrode, method and apparatus to produce high concentrations of hydrogen peroxide at high current efficiencies over an extended period of operation.

SUMMARY OF THE INVENTION

The present invention provides for the use of quaternary ammonium compounds within a cathodic electrocatalyst layer supported on a cathodic gas diffusion electrode for electrochemical production of aqueous hydrogen peroxide. The cathodic gas diffusion electrode comprises an electrically conductive gas diffusion substrate having first and second sides, and a cathodic electrocatalyst layer supported on one side only of the gas diffusion substrate, wherein the cathodic electrocatalyst layer comprises a cathodic electrocatalyst, a substantially water insoluble quaternary ammonium compound, a fluorocarbon polymer, and a proton-conducting polymer. A preferred proton-conducting polymer is a perfluoronated sulphonic acid polymer. The gas diffusion substrate is preferably carbon cloth or carbon fiber paper. Optionally, the cathodic electrocatalyst layer is supported on one side of the gas diffusion substrate.

The cathodic electrocatalyst is preferably a pyrolyzed cobalt-containing macrocyclic compound, such as cobalt tetramethoxyphenylporphorine or cobalt phthalocyanine, supported on high surface area carbon powder, carbon fibers, and/or single-walled, or multi-walled carbon nanotubes. Optionally, the composition of the cobalt-carbon cathodic electrocatalyst is about 0.2 to 3.0 weight percent cobalt. The quaternary ammonium compound is preferably a diquaternary ammonium compound (referred to as a "diquat"), such as N-N'-tetramethyl, octadecyl, 1,3-propyldiamine.

A preferred cathodic electrocatalyst layer comprises a high surface area cobalt-carbon catalyst material with a composition of 0.2 to 3.0 wt. % cobalt. A preferred cathodic electrocatalyst layer may include from 20 to 80 weight percent of the cathodic electrocatalyst, from 5 to 40 weight percent of the quaternary ammonium compound, from 5 to 45 weight percent of the fluorocarbon polymer binder; from 5 to 35 weight percent of the perfluoronated sulphonic acid polymer; or a combination of these amounts.

Another embodiment of the invention provides a membrane and electrode assembly, comprising a gas diffusion electrode of the invention and further comprising an anode and a proton conducting membrane disposed in intimate contact between the anode and the cathodic electrocatalyst layer of the gas diffusion electrode.

Yet another embodiment of the invention provides electrochemical cells comprising a plurality of the membrane and electrode assemblies of the invention arranged in an electrochemical cell stack.

A still further embodiment of the invention provides a method of making a cathode structure for electrochemical production of hydrogen peroxide. The method may comprise mixing a cobalt-carbon catalyst, a quaternary ammonium composition, and a polytetrafluoroethylene suspension, applying a layer of the mixture onto one side of a gas diffusion substrate, and then applying a suitably solubilized perfluoronated sulphonic acid polymer over the layer of the mixture. Optionally, the method may further comprise hot pressing the gas diffusion substrate to a surface of a cation exchange membrane with the layer of the mixture therebetween. In a further option, the method may include disposing an anode, such as an iridium dioxide anode, in contact with an opposing surface of the cation exchange membrane.

An alternative method of making a cathode structure for electrochemical production of hydrogen peroxide comprises applying a mixture of a cobalt-carbon catalyst, a quaternary ammonium composition, and a perfluoronated sulphonic acid polymer, and applying the mixture to one side of a gas diffusion substrate.

DETAILED DESCRIPTION

Figure 1:
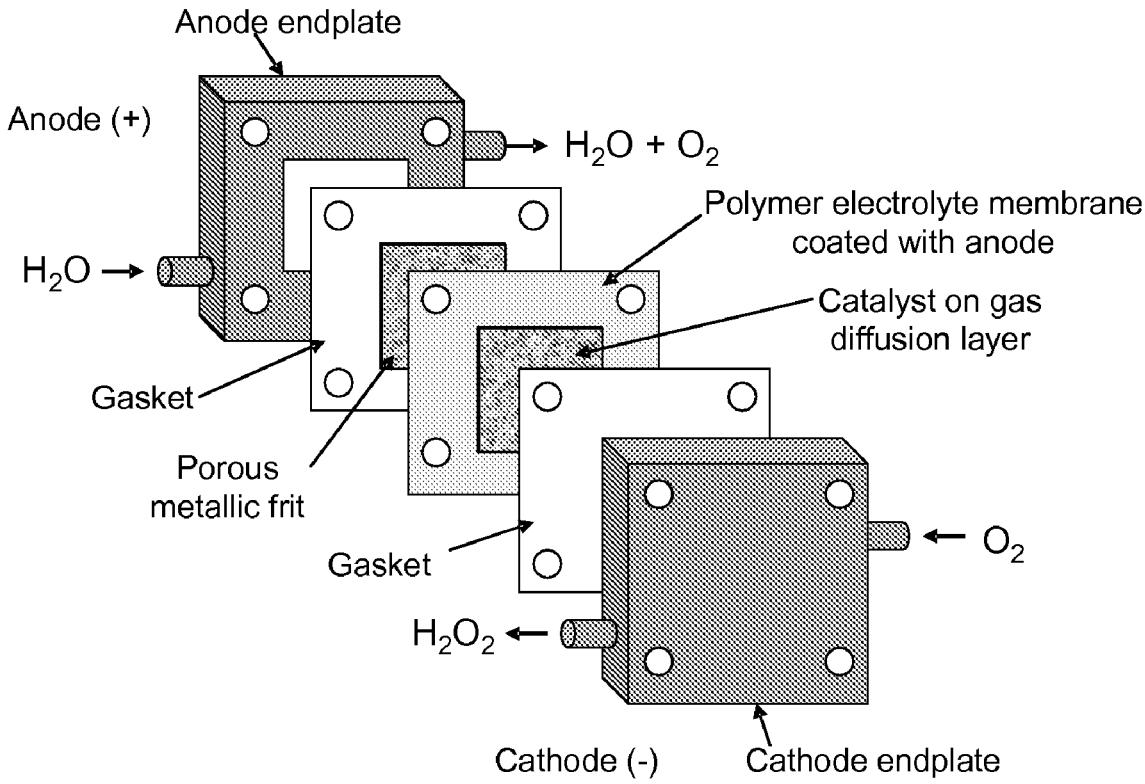
FIG. 1 is an exploded schematic diagram of the components in an electrochemical cell for the generation of hydrogen peroxide.

The present invention provides a cathodic gas diffusion electrode for electrochemical production of aqueous hydrogen peroxide. The cathodic gas diffusion electrode comprises an electrically conductive gas diffusion substrate and a cathodic electrocatalyst layer supported on one side of the gas diffusion substrate. A novel cathodic electrocatalyst layer comprises a mixture of a cathodic electrocatalyst, a substantially water insoluble quaternary ammonium compound, a fluorocarbon polymer hydrophobic agent and binder, and a perfluoronated sulphonic acid polymer. An electrochemical cell using the novel cathodic electrocatalyst layer has been shown to produce an aqueous solution having between 8 and 14 weight percent hydrogen peroxide and average current efficiencies of approximately 30 to 38%. Furthermore, such electrochemical cells have shown stable production of hydrogen peroxide solutions over 1000 hours of operation including numerous system shutdowns.

To achieve the maximum efficiency and concentration of hydrogen peroxide from the cell, an optimal cathodic electrode architecture is needed to allow optimal flow of reactants to the catalytic site and optimal removal of the products from the reactive sites. To maximize the hydrogen peroxide concentration produced from the cell, the cathodic electrocatalyst layer must effectively transport oxygen, protons, and electrons to the catalytic site and effectively remove hydrogen peroxide and water from the electrode, as described by Eq. 1-5 and related text.

The gas diffusion substrate is preferably carbon cloth or carbon fiber paper. Any element that allows gas diffusion, does not degrade the hydrogen peroxide, and is electrically conductive can potentially function as a gas diffusion substrate. Optionally, the cathodic electrocatalyst layer is supported on a gas diffusion substrate.

A catalyst with a high selectively and high efficiency for the two-electron reduction of oxygen to hydrogen peroxide (Eq. 3) rather than the four-electron reduction of oxygen to water (Eq. 4) is needed to produce high concentrations of hydrogen peroxide. The precursor cathodic electrocatalyst is preferably a transition metal-containing macrocyclic compound, for example a metalloporphyrin, such as cobalt tetramethoxyphenylporphorine or cobalt phthalocyanine. Other possible catalysts include carbon, iron-containing porphyrins, redox polymers, and platinum-based catalysts. Optionally, the composition of the cobalt-carbon cathodic electrocatalyst derived from pyrolyzing the cobalt tetramethoxyphenylporphorine or cobalt phthalocyanine supported on high surface area carbon is from about 0.2 to 3.0 weight percent cobalt. Still further, the cathodic electrocatalyst is adsorbed onto high surface area carbon powder and pyrolyzed onto carbon. A preferred cathodic electrocatalyst layer may include from 20 to 80 weight percent of the cathodic electrocatalyst.

The cathodic electrocatalyst layer also includes a substantially water-insoluble quaternary ammonium compound. Diquaternary ammonium compounds of the present invention are compounds containing two quaternary ammonium groups connected together with a short aliphatic carbon chain or a small ring, whereby the chain or the ring may be saturated or unsaturated. Different diquaternary ammonium compounds may be used with different effects simply by changing the length or size of the chain or ring between the nitrogen atoms. The diquaternary ammonium compounds used in the present invention are synthesized by combining tertiary diamines with a stoichiometric molar excess of alkyl halides to produce diquaternary ammonium halides. The diaquats can contain chloride, bromide, iodide, or other anions. The preferred alkyl halides are the alkyl chlorides, such as 1-Chlorooctadecane or 1-Chlorodecane, or the alkyl iodides, such as 1-Iodooctadecane or 1-Iododecane. The alkyl halides should be selected to ensure that the diquaternary ammonium compounds have low water solubility, such as an alkyl halide having ten carbon atoms. If the starting tertiary diamines already have low water solubility, then other alkyl halides with fewer carbon atoms would be suitable. However, in the examples disclosed herein, water insolubility of the diquaternary ammonium compound is ensured by including an alkyl halide with an alkyl group having at least ten carbon atoms. In accordance with the invention, the alkyl group may be either saturated or unsaturated and either straight or branched.

Other quaternary ammonium compounds include monoquaternary ammonium compounds with hydrophobic alkyl chains of varying chain length. The diquaternary ammonium compounds can be synthesized as disclosed in U.S. 2004/0115107 (Singh). The role of the water-insoluble quaternary ammonium compound is specifically to improve the hydrophobic character of the cathodic electrocatalyst layer and prevent decomposition of the produced hydrogen peroxide. The long alkyl chains of the "diquat" can limit the interaction of hydrogen peroxide with the surface of the electrocatalyst, thereby preventing further electroreduction. The specific use of the diquat compound rather than a high molecular weight polymer may allow improved penetration within the pore structure of the electrocatalyst and thereby improve the hydrophobic character of the electrocatalyst. Based on the relatively low loading of the transition metal catalyst on the carbon powder support (0.2 to 3.0 wt % Co), a significant surface area of the catalyst support is available for further electrochemical reduction of the hydrogen peroxide (Eq. 4 and Eq. 5). The use of a quaternary ammonium compound within the electrocatalyst layer specifically reduces the interaction of produced hydrogen peroxide, thereby limiting its decomposition and resulting in higher concentrations of hydrogen peroxide. A preferred cathodic electrocatalyst layer may include from 5 to 40 weight percent of the quaternary ammonium compound.

A fluorocarbon polymer is incorporated into the cathodic electrocatalyst layer as a binder, but may also enhance the hydrophobicity within the electrocatalyst layer. The polymeric component should be chemically stable to hydrogen peroxide. Non-limiting examples of a suitable fluorocarbon polymer include polytetrafluoroethylene (PTFE), polyvinylidene fluoride (PVDF), polyvinylfluoride (PVF), polychlorotrifluoroethylene (PCTFE) and the like. A preferred binder is polytetrafluoroethylene (PTFE), which is available as TEFLON® (E.I. DuPont of Wilmington, Del.). The fluorocarbon polymer is preferably provided as a suspension, such as an aqueous suspension of 60.4% PTFE and 5% surfactant (Triton X-100). A preferred cathodic electrocatalyst layer may include from 5 to 45 weight percent of the fluorocarbon polymer binder.

A perfluoronated sulphonic acid polymer is also included within the cathodic electrocatalyst layer. The preferred proton conducting material should be stable to hydrogen peroxide. In addition to perfluoronated sulphonic acid polymers, other suitable proton conducting compounds may be used. A preferred cathodic electrocatalyst layer may include from 5 to 35 weight percent of the perfluoronated sulphonic acid polymer or other proton-conducting compound.

In one embodiment, the cathodic electrocatalyst layer is formed by preparing and sonicating a paste composed of the water-insoluble quaternary ammonium compound dissolved in methanol, the cathodic electrocatalyst, the fluorocarbon polymer binder, and water. The paste is then applied onto one side of a gas diffusion substrate and heated to remove the solvent(s) and surfactant contained within the Teflon suspension. The process may also interconnect the fluorocarbon polymer chains. The perfluoronated sulphonic acid polymer is then painted on the cathodic electrocatalyst layer.

In one embodiment, a completed cathodic gas diffusion electrode structure is then combined with a proton conducting membrane and an anode to form a membrane and electrode assembly (MEA). The MEA is placed between endplates or other current collectors by supplying a source of oxygen to the cathodic gas diffusion electrode, supplying water to the anode, and applying an electrical potential between the anode and cathode. Hydrogen peroxide is produced at the cathode and may be withdrawn from the cathode chamber along with water. This aqueous solution preferably contains between 8 and 14 weight percent hydrogen peroxide.

Yet another embodiment of the invention provides electrochemical cells comprising a plurality of the membrane and electrode assemblies of the invention arranged in an electrochemical cell stack. Bipolar plates and fluid flowfields are interposed between membrane and electrode assemblies to form a stack of cells that operate in series. The configuration of the bipolar plates, flowfields, endplates and supporting structures to form electrochemical cell stacks are well-known to those having ordinary skill in the art.

A still further embodiment of the invention provides a method of making a cathode structure for electrochemical production of hydrogen peroxide. The method may comprise applying a mixture of a cobalt-carbon catalyst, a quaternary ammonium composition, and a polytetrafluoroethylene suspension to one side of a gas diffusion substrate, and then applying a layer of perfluoronated sulphonic acid polymer over the exposed surface of the mixture. Optionally, the cathodic gas diffusion structure may be secured to a proton conducting membrane, such as in the formation of a membrane and electrode assembly. Such a method may include hot pressing the gas diffusion substrate to a surface of a cation exchange membrane with the layer of the mixture therebetween. In a further option, the method may include disposing an anode, such as an iridium dioxide, ruthenium dioxide, or platinum anode, in contact with an opposing surface of the cation exchange membrane.

An alternative method of making a cathode structure for electrochemical production of hydrogen peroxide, comprises mixing a cobalt-carbon catalyst, a quaternary ammonium composition, and a perfluoronated sulphonic acid polymer, and applying a layer of the mixture onto one side of a gas diffusion substrate.

Example 1

A cobalt-containing catalyst material for the cathode was prepared by first dissolving a weighed amount of a cobalt (TI) porphyrin (Co-tetramethoxyphenylporphyrine, CoTMPP) into dimethylformamide (DMF). A weighed amount of high surface area carbon black (Black Pearls 2000, Cabot) was dispersed in the solution. The suspension containing the carbon black, DMF and CoTMPP was stirred at 60° C. for 16 hours. The carbon containing the adsorbed cobalt (II) porphyrin was filtered and washed with aliquots of deionized water. The filtered carbon was then dried at 75° C. under 25 mm Hg vacuum for four hours and then cooled. The dried powder was then weighed and placed in a sealed quartz tube within a tube furnace. The quartz tube was evacuated to less than 10 millitorr, and then filled back to 720 torr with ultra high purity (UHP) argon or nitrogen. This procedure was repeated 5 times to ensure oxygen removal. The carbon powder was then subjected to a preliminary drying step by ramping the tube furnace from ambient temperature to 150° C. at 5° C./min and then holding the temperature at 150° C. for 30 minutes under 100 mL/min UHP argon or nitrogen flow, with vacuum on and open (approx. 1 torr pressure). The quartz tube pressure was then adjusted to 450 torr, and the carbon powder was pyrolyzed under UHP argon or nitrogen flow by ramping the tube temperature at 10° C./min to 850-900° C. The pyrolysis conditions were maintained for 2 hours, and the quartz tube was then allowed to cool to ambient temperature. After at least 12 hours, the vacuum in the quartz tube was purged back to atmospheric pressure, and the carbon catalyst material was removed. The catalyst was mortared and mixed. The flask containing the filtrate and deionized water washings was digested by EPA SW-846 method 3050, and analyzed for cobalt using an Inductively Coupled Plasma-Optical Emission Spectrometer. The amount of cobalt adsorbed onto the carbon was determined by subtracting the mass of cobalt in the filtrate from the amount of cobalt in the original solution.

Membrane electrode assemblies (MEAs) were prepared, as presented in FIG. 1, by first coating an $IrO_2$ anode on a polymer electrolyte membrane (Nafion 117, Ion Power). The polymer electrolyte membrane was first pre-treated by boiling in dilute hydrogen peroxide, soaking in 1 M sulfuric acid, and subsequently boiling in deionized (DI) water. The $IrO_2$ anode was coated directly on the proton exchange membrane by applying a paint consisting of 100 mg iridium(IV) oxide, 120 μL DI water, 63.2 μL n-propanol, and 58 μL Nafion solution (15% by wt) to the membrane. The $IrO_2$ paint was applied in two to three steps and pressed at 5,000 lbs at 160° C. for 45 seconds between each application of the paint.

To prepare the cathode, the carbon-supported cobalt-containing catalyst was coated onto one side of a gas diffusion substrate. A catalyst paste consisting of 218 mg of the cobalt-containing catalyst, 270 mg Telfon suspension composed of 60.4 weight % PTFE and 5 weight % surfactant (Triton X-100), 50 mg N-N'-tetramethyl, octadecyl-1,3-propyldiamonium chloride (diquat) dissolved in 500 μL methanol and 400 μL DI water was prepared and sonicated. The diquaternary ammonium compound was synthesized as disclosed in U.S. Pat. No. 7,189,380 (Singh). The catalyst paste was uniformly applied to a 5×5 $cm^2$ piece of a carbon cloth gas diffusion substrate (ELAT/SS/C/V3.1-LP, E-TEK) and heated at 290° C. for 5 minutes. The heating step was specifically used to remove the solvent(s) and surfactant within the Teflon suspension and result in bonding between the Teflon and carbon catalyst support. A Nafion suspension (7.5 wt % in a water, propanol, methanol mixed solvent) was then painted on the catalyst-coated gas diffusion substrate using multiple steps, and the electrode was allowed to dry at room temperature between coats. After drying, the catalyst-coated gas diffusion substrate was heated at 125° C. for 30 minutes. The gas diffusion substrate was weighed before and after the Nafion coating to determine the amount of Nafion added to the electrode. The MEA was formed by placing the catalyst-coated gas diffusion substrate side down onto the polymer electrolyte membrane containing the anode and then pressing the assembly at 9,000 lbs at a temperature of 160° C. for 90 seconds.

The cell was assembled as shown in FIG. 1 by placing the MEA (polymer electrolyte/electrode assembly) between end plates containing flow fields, and the assembly was sealed using gaskets that were cut to size. A titanium endplate coated with TiN or other proprietary coating was used for the anode and a nickel-coated titanium endplate was used for the cathode. An $IrO_2$-coated porous titanium frit (ASTRO Met Inc. or ADMA Products Group, 40-50% porosity) was used between the $IrO_2$ anode and the anode endplate. The $IrO_2$ was coated on the porous titanium frit by coating a solution of $IrCl_3$ in isopropanol on the frit followed by heating at 400° C. for 10 minutes, and this procedure was repeated over multiple steps, followed by a final heating at 400° C. for 30 minutes. The end plates were restrained together by applying a torque of 80 in-lbs to four stainless steel bolts that were insulated from the endplates using washers or electrical insulation.

Figure 2:
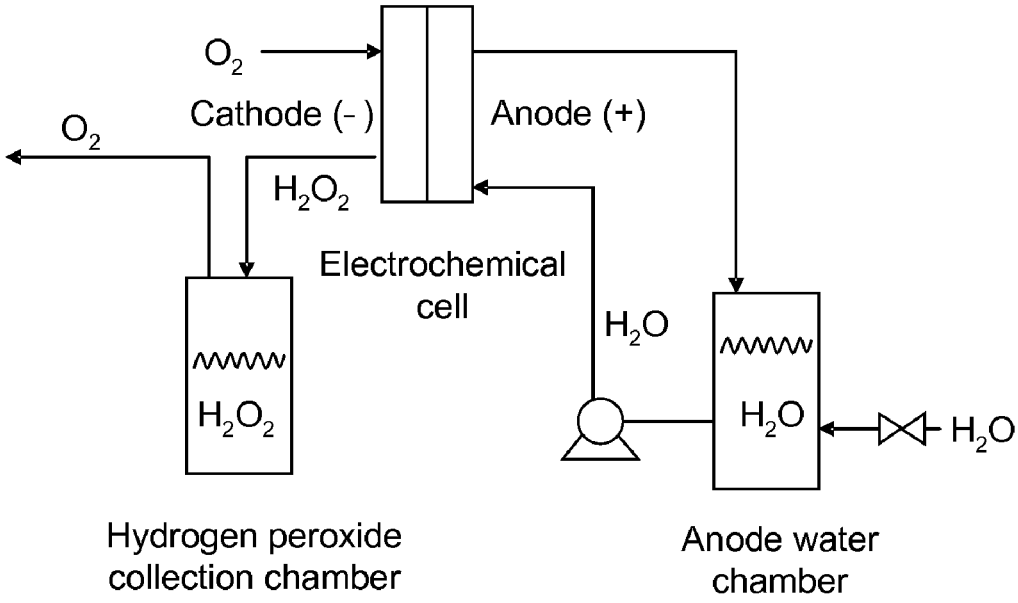
FIG. 2 is a process flow diagram of a system for generating hydrogen peroxide using an electrochemical cell which operates on oxygen fed directly to the cathode and water fed to the anode.

The cell was placed in a configuration as shown in FIG. 2. Water was fed into the anode compartment, and the water temperature was controlled by pumping the water through a temperature-controlled bath. High purity oxygen was fed at a flow rate of 20-150 mL/hour into the cathode compartment directly. A pressure of 25 psi was applied to the cell by using an in-line check valve after the hydrogen peroxide collection chamber. The positive pole of a suitable DC power supply was connected to the anode and the negative pole was connected to the cathode. To generate the hydrogen peroxide, a constant current density of 200 $mA/cm^2$ was applied between the two electrodes using a Lambda or Sorensen power supply. The hydrogen peroxide solution leaving the cathode chamber was collected in a pressure vessel. The reaction was run for a specified time period (2-25 hours), and then stopped. After the reaction was halted, the sample volume and hydrogen peroxide concentration were determined. The hydrogen peroxide concentration was determined by titration with potassium permanganate, as per the equation: $2KMnO_4+5H_2O_2+3H_2SO_4 \rightarrow 2MnSO_4+K_2SO_4+8H_2O+5O_2$. The current efficiency was calculated as moles $H_2O_2$ produced/moles $H_2O_2$ expected from the current applied.

Figure 4:
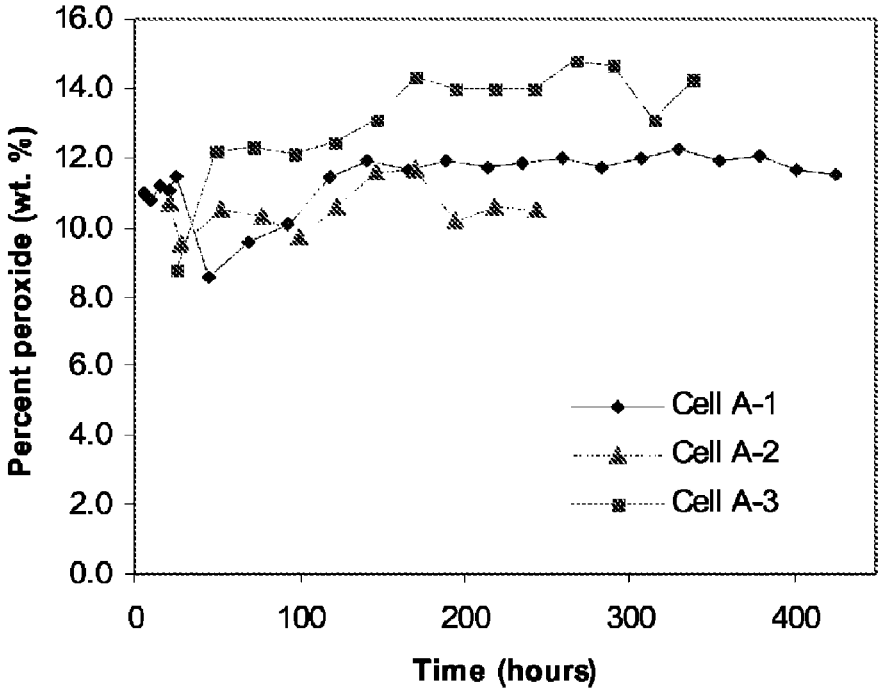
FIG. 4 is a graph of peroxide yields as a function of time for three electrochemical cells with active electrode areas of 25 $cm^2$ operating at a current density of 200 $mA/cm^2$, a cell voltage of 1.6-1.8 V, a cell temperature of 16-22° C., and an oxygen flow rate of 50-150 mL/min.

Three cells (A-1, A-2, and A-3) were prepared using a carbon-supported cobalt catalyst containing 2.9 wt % cobalt and Nafion loadings of 1.2-3.0 $mg/cm^2$. The cell temperatures measured at the cathode were 18-22° C. Cells A-1, A-2, and A-3 were deliberately stopped after running for a specified time period, and the results are shown in FIG. 4. The average weight percents of hydrogen peroxide for the cells were 11.3, 10.5, and 13.1 for cells A-1, A-2, and A-3, respectively. The average product flow rates in mL/hour for the cells were 9.3, 9.1, and 9.0 for cells A-1, A-2, and A-3 respectively. Average current efficiencies for the cells were determined as 33.4%, 30.4% and 37.5% for cells A-1, A-2, and A-3 respectively. A peak yield of 14.8 wt % hydrogen peroxide was obtained for one run of cell A-3. The experiments demonstrate that the electrocatalyst formulation consisting of the carbon-supported cobalt catalyst, diquat, Teflon, and Nafion produces high concentrations of hydrogen peroxide over extended time periods and demonstrates that the results are repeatable.

Example 2

The composition of the carbon-supported cobalt catalyst was altered to determine the effect of the weight percent cobalt within the catalyst on the concentration of hydrogen peroxide obtained from the cell. Two additional catalyst batches were prepared as described in Example 1, however the cobalt loadings were determined as 0.6 weight % and 0.2 weight % cobalt rather than the 2.9 weight % cobalt described in Example 1. The catalysts were pyrolyzed as described in Example 1. Cathodes and cells were prepared as described in Example 1, and identical testing was performed. The cell containing the 0.6 wt % cobalt-containing catalyst produced an average yield of 4.7 weight percent hydrogen peroxide. The cell containing the 0.2 wt % Co catalyst also produced an average yield of 4.7 weight percent hydrogen peroxide. In contrast, the cell made using a 2.9 weight % cobalt catalyst gave average hydrogen peroxide weight percents of 11.3, 10.5, and 13.1 for cells A-1, A-2, and A-3, respectively. The experiments demonstrate that given identical electrocatalyst formulations (Nafion, diquat and Teflon content) the specific amount of cobalt within the catalyst has a large effect on the resulting hydrogen peroxide produced from the cell and can be optimized to maximize the concentration of hydrogen peroxide obtained from the cell. The results further show that the highest concentrations of hydrogen peroxide are obtained with a 2.9 weight % cobalt catalyst from among the compositions tested (0.2, 0.6 and 2.9 weight percent cobalt).

Example 3

Figure 5:
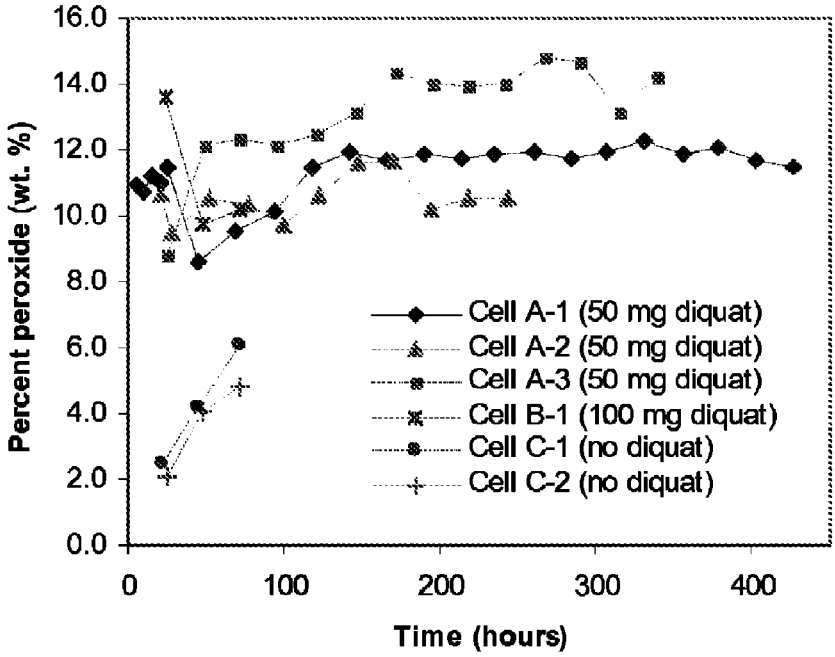
FIG. 5 is a graph of peroxide yields as a function of time for electrochemical cells with active electrode areas of 25 $cm^2$ containing a cathodic electrocatalyst layer with a cobalt-based catalyst and a perfluoronated sulphonic acid polymer with and without the inclusion of a diquat compound and operating at an oxygen feed rate of 20-150 mL/min, an inlet water temperature of 15-22° C. and a current density of 200 $mA/cm^2$.

Membrane electrode assemblies (MEAs) were prepared to determine the effect of N-N'-tetramethyl, octadecyl-1,3-propyldiamine (diquat or diquat 17) within the cathodic electrocatalyst layer on the concentration of hydrogen peroxide obtained from the cell. MEAs were prepared as described in Example 1, except the amount of diquat was changed in the cathode paste formulation. The catalyst for these cells contained 2.9 wt % cobalt supported on carbon powder as described in Example 1. Cells were assembled and tested as described in Example 1. Two cells were made using no diquat (cells C-1 and C-2), and an additional cell (B-1) was made with 100 mg diquat. The results of the test are shown in FIG. 5, which also includes cells prepared containing 50 mg diquat (cells A-1, A-2, and A-3). The results presented in FIG. 5 demonstrate that given identical electrocatalyst formulations (catalyst amount and composition, Nafion content, and Teflon content) the specific amount of diquat within the electrocatalyst layer has a large effect on the resulting hydrogen peroxide produced from the cell. The results show that the incorporation of diquat within the cathode clearly results in higher concentrations of hydrogen peroxide obtained from the cell compared to the cells without diquat within the cathode. Cells C-1 and C-2, without diquat, produced an average of 4.3 weight % and 3.6 weight % hydrogen peroxide. Cells A-1, A-2, A-3, and B-1, containing diquat, produced 11.3, 10.5, 13.1, and 11.2 weight % hydrogen peroxide respectively. As described above, the higher concentration of hydrogen peroxide obtained for the cells containing diquat within the cathodic gas diffusion electrode is attributed to the enhanced hydrophobicity within the electrocatalyst layer. The enhanced hydrophocity reduces decomposition of the hydrogen peroxide through decreasing its interaction with active catalytic sites and/or the catalytic support.

Example 4

Membrane electrode assemblies (MEAs) were prepared to determine the effect of Nafion content within the cathode on the concentration of hydrogen peroxide obtained from the cell. The catalyst layer for these cells contained 2.9 wt % of the cobalt-containing catalyst. Cells were assembled and tested as described in Example 1. Two cells (Cells D-1 and D-2) were made using no Nafion within the cathode electrocatalyst layer. The results of the experimental testing of cells D-1 and D-2 along with cells prepared with Nafion within the cathode electrocatalyst layer (cells A-1, A-2 and A-3) are shown in FIG. 6.

Figure 6:
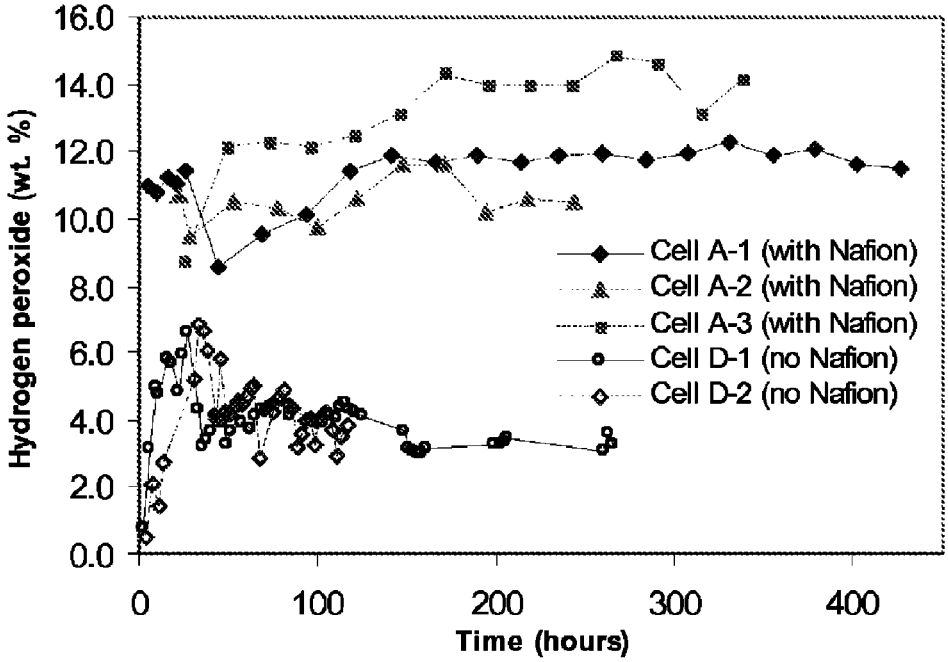
FIG. 6 is a graph of peroxide yields as a function of time for electrochemical cells with active electrode areas of 25 $cm^2$ containing a cathodic electrocatalyst layer with a cobalt-based catalyst and a diquat compound with (Cell A-1, A-2, A-3) and without (Cell D-1, D-2) the inclusion of a perfluoronated sulphonic acid polymer and operating at an oxygen feed rate of 20-150 mL/min, an inlet water temperature of 15-22° C. and a current density of 200 $mA/cm^2$

The results presented in FIG. 6 demonstrate that given identical electrocatalyst formulations (catalyst amount and composition, diquat content and Teflon content) the specific incorporation of Nafion within the cathode electrocatalyst layer has a large effect on the resulting amount of hydrogen peroxide produced from the cell. The cells containing Nafion within the cathode electrocatalyst layer, cells A-1, A-2, and A-3 produced average hydrogen peroxide weight percents of 11.3, 10.5, and 13.1, respectively. In contrast, cells D-1 and D-2, without Nafion within the cathode electrocatalyst layer, produced 3.9 and 4.1 weight % hydrogen peroxide respectively. The inclusion of Nafion within the cathode electrocatalyst layer more than doubled the average hydrogen peroxide concentration obtained from the cell. The higher concentrations of hydrogen peroxide obtained for cells containing Nafion within the cathode electrocatalyst layer is attributed to Nafion improving the proton transport within the cathode electrocatalyst layer. The inclusion of Nafion or other proton conducting component within the cathode electrocatalyst layer can specifically improve proton transport to the active cobalt catalytic sites within the electrocatalyst layer. The cobalt catalytic sites are selective for the "two electron reduction process" (Eq. 3) over the "four electrode reduction process" (Eq. 4). Oxygen reduction can also occur at the carbon catalyst support rather than at the active catalytic sites, however on the carbon support the selectivity for the two electrode reduction process (Eq. 3) which produces hydrogen peroxide is generally very low and the four electron reduction process (Eq. 4) which produces water may be preferred. The inclusion of Nafion or other proton conducting component within the cathodic electrocatalyst layer acts to transfer protons to the active, catalytic sites that are selective for the two electrode reduction process (Eq. 3), thereby producing high concentrations of hydrogen peroxide. Without the incorporation of Nafion or other proton conducting component, protons are transported to sites on carbon that are not highly selective for the two electrode reduction process over the four electron reduction process. The inclusion of Nafion or other proton conducting component is specifically needed to impart proton conduction within the catalyst layer applied to a gas diffusion electrode where gas is flowed to the cathode compartment rather than within a "flow-by" or "flow-through" electrode configuration in which mobile ions are present within an acidic or basic electrolyte solution. Additionally, the results presented in FIG. 5 and FIG. 6 demonstrate that both diquat and the Nafion are needed within a cathode electrocatalyst layer of a gas diffusion electrode in order to obtain high concentrations of hydrogen peroxide.

Example 5

Experiments were performed with different gas compositions, applied pressures, cell temperatures, and current densities to obtain the highest weight percent hydrogen peroxide from the cells. MEAs were prepared as described in Example 1, and the catalyst for these cells contained 2.9 wt % of the cobalt-containing catalyst. Cells were assembled and tested as described in Example 1. The results, shown in Table 1, indicate that the gas composition, applied pressure, cell temperature, and current density influence the product flow rate, current efficiency, and weight percent hydrogen peroxide obtained from the cell. The results shown in Table 1 demonstrate that the cells can be operated using air rather than high purity oxygen. The highest peroxide yields were obtained using high purity oxygen at an applied pressure of 25 psi.

TABLE 1

| Parameter | Value | Trial | Product Flow Rate (mL/hr) | Current Efficiency (%) | $H_2O_2$ (% w/w) |
|---|---|---|---|---|---|
| Gas | 99.9% $O_2$ | NCM-W | 9.6 | 34.7 | 11.50 |
| Composition | 20.9% $O_2$ | NCM-AA | 8.0 | 8.1 | 3.22 |
| Pressure | 25 psi | NCM-W | 9.6 | 34.7 | 11.50 |
| | Ambient | NCM-CA | 8.4 | 18.1 | 6.88 |
| Cell | 16.7° C. | NCM-BA | 9.5 | 32.7 | 10.97 |
| Temperature | 6.5° C. | NCM-EA | 8.6 | 30.2 | 11.08 |
| Current | 200 mA/cm$^2$ | NCM-BA | 9.5 | 32.7 | 10.97 |
| Density | 300 mA/cm$^2$ | NCM-DA | 12.9 | 30.3 | 11.20 |

Example 6

Figure 3:
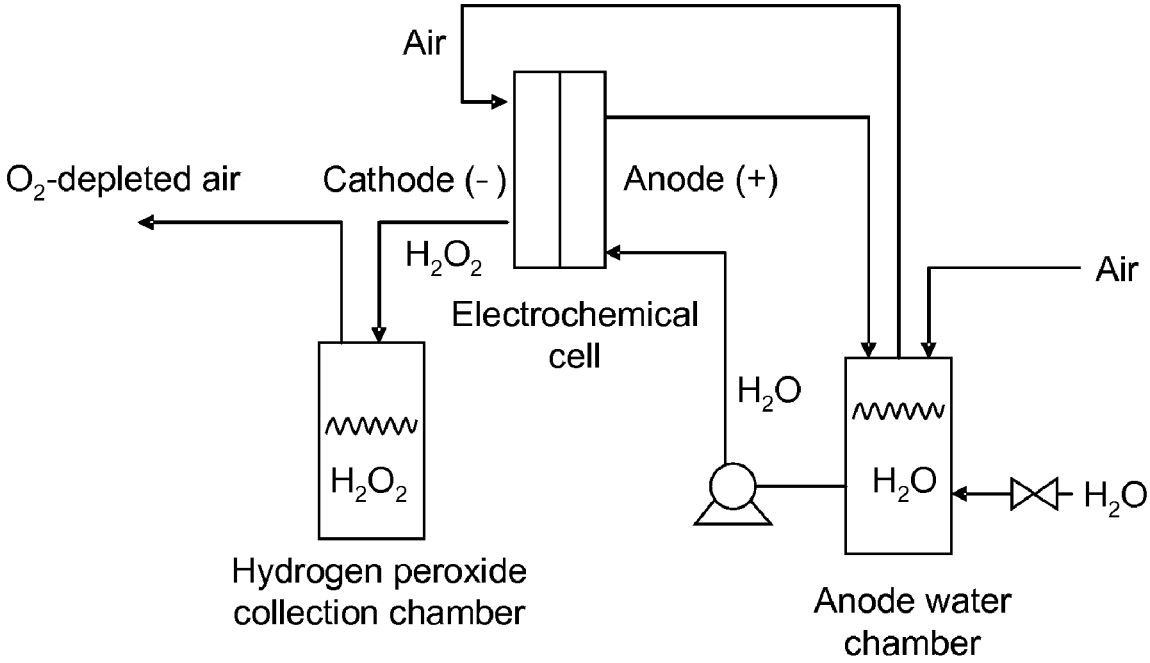
FIG. 3 is a process flow diagram of a system for generating hydrogen peroxide using an electrochemical cell which operates on air, electrogenerated oxygen, and water.

Testing was performed to determine the effect of using air rather than oxygen fed to the cathode compartment and evaluate the long-term performance of the cells. MEAs were prepared as described in Example 1, and the catalyst for these cells contained either 2.9 weight % cobalt (cells E-1 and E-2) or 2.2 weight % cobalt (cell F-1). Cells were assembled and tested as described in Example 1, however the cells were fed air (20.9% oxygen) rather than high purity oxygen (99.99%). The cells were connected in a cell configuration that fed the air through the anode water chamber which allows the oxygen generated at the anode to be used at the cathode, as shown in FIG. 3. This cell configuration results in oxygen-enriched air being fed to the cathode. The exit gas flow rate was 50 mL/hour. The results of the hydrogen peroxide yield as a function of time for the three cells is shown in FIG. 7.

Figure 7:
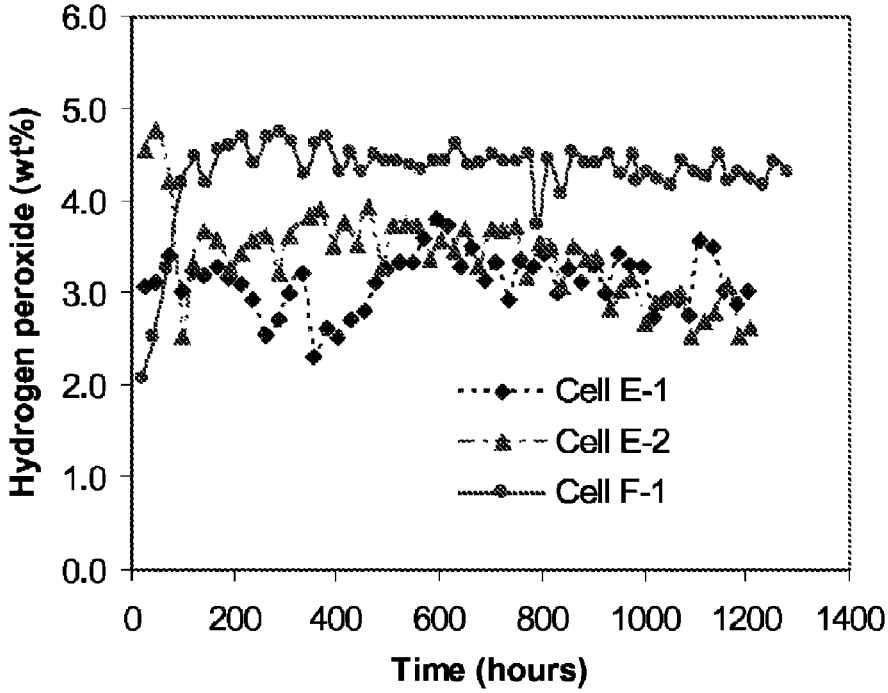
FIG. 7 is a graph of peroxide yields as a function of time for electrochemical cells with active electrode areas of 25 $cm^2$ fed with air to the cathode and operating at a current density of 200 $mA/cm^2$, a cell voltage of 1.6-1.8 V, a cell temperature of 16-22° C., and a gas flow rate of 50 mL/min.

The results shown in FIG. 7 demonstrate that the cells using the aforementioned electrocatalyst layer containing a cobalt catalyst, diquat, Teflon, and Nafion produces stable yields of hydrogen peroxide for extended times of more than 1200 hours using multiple on/off cycles operating on air fed directly into the cathode.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A cathodic gas diffusion electrode for electrochemical production of aqueous hydrogen peroxide, comprising:

an electrically conductive gas diffusion substrate; and a cathodic electrocatalyst layer supported on one side of the gas diffusion substrate, wherein the cathodic electrocatalyst layer comprises a cathodic electrocatalyst, a substantially water-insoluble quaternary ammonium compound, a fluorocarbon polymer binder, and a perfluoronated sulphonic acid polymer.

2. The cathodic gas diffusion electrode of claim 1, wherein the quaternary ammonium compound is a diquaternary ammonium compound.

3. The cathodic gas diffusion electrode of claim 2, wherein the diquaternary ammonium compound is N-N'-tetramethyl, octadecyl, 1,3-propyldiammonium chloride.

4. The cathodic gas diffusion electrode of claim 1, wherein the cathodic electrocatalyst is derived from pyrolyzing cobalt tetramethoxyphenylporphorine, or cobalt phthalocyanine, supported on a carbon material.

5. The cathodic gas diffusion electrode of claim 4, wherein the cathodic electrocatalyst is about 0.2 to 10.0 weight percent cobalt.

6. The cathodic gas diffusion electrode of claim 4, wherein the cathodic electrocatalyst is highly dispersed cobalt supported on high surface area carbon.

7. The cathodic gas diffusion electrode of claim 4, wherein the carbon material is selected from the group consisting of high surface area carbon powder, carbon fibers, carbon nanotubes, and combinations thereof.

8. The cathodic gas diffusion electrode of claim 6, wherein the quaternary ammonium compound is a diquaternary ammonium compound.

9. The cathodic gas diffusion electrode of claim 8, wherein the diquaternary ammonium compound is N-N'-tetramethyl, octadecyl, 1,3-propyldiammonium chloride.

10. The cathodic gas diffusion electrode of claim 1, wherein the gas diffusion substrate is carbon cloth or carbon fiber paper.

11. The cathodic gas diffusion electrode of claim 1, wherein the cathodic electrocatalyst layer is supported on a gas diffusion substrate.

12. The cathodic gas diffusion electrode of claim 1, wherein the cathodic electrocatalyst layer includes from 20 to 80 weight percent of the cathodic electrocatalyst.

13. The cathodic gas diffusion electrode of claim 1, wherein the cathodic electrocatalyst layer includes from 5 to 40 weight percent of the quaternary ammonium compound.

14. The cathodic gas diffusion electrode of claim 1, wherein the cathodic electrocatalyst layer includes from 5 to 45 weight percent of the fluorocarbon polymer binder.

15. The cathodic gas diffusion electrode of claim 1, wherein the cathodic electrocatalyst layer includes from 5 to 35 weight percent of the perfluoronated sulphonic acid polymer.

16. A membrane and electrode assembly, comprising the gas diffusion electrode of claim 1 and further comprising:

an anode; and a proton conducting membrane disposed in intimate contact between the anode and the cathodic electrocatalyst layer of the gas diffusion electrode.

17. A plurality of electrochemical cells comprising a plurality of membrane and electrode assemblies of claim 16 arranged in an electrochemical cell stack.

18. A method of making a cathode structure for the electrochemical production of hydrogen peroxide, comprising:

mixing a carbon-supported cobalt catalyst, a quaternary ammonium composition, and a polytetrafluoroethylene suspension;

applying the mixture over one side of a gas diffusion substrate; and applying a layer of perfluoronated sulphonic acid polymer over the mixture.

19. The method of claim 18, further comprising:

hot pressing the gas diffusion substrate to a surface of a cation exchange membrane with the layer of the mixture therebetween.

20. The method of claim 19, further comprising:

disposing an anode in contact with an opposing surface of the cation exchange membrane.

21. The method of claim 20, wherein the anode comprises iridium dioxide.

22. A method of making a cathode structure for the electrochemical production of hydrogen peroxide, comprising:

mixing a carbon-supported cobalt catalyst, a quaternary ammonium composition, and a perfluoronated sulphonic acid polymer; and applying a layer of the mixture onto one side of a gas diffusion substrate.

* * * * *